United States Patent [19]

Wiebe et al.

[11] 4,004,525

[45] Jan. 25, 1977

[54] FLUID TRUCK SNUBBER

[75] Inventors: Donald Wiebe, Sewickley; John H. Wagner, Bradfordwoods, both of Pa.

[73] Assignee: A. Stucki Company, Pittsburgh, Pa.

[22] Filed: Mar. 28, 1975

[21] Appl. No.: 563,147

[52] U.S. Cl. ..... 105/197 DH; 267/8 R; 267/9 A

[51] Int. Cl.[2] ..... B61F 5/06; B61F 5/12; B61F 5/24; B61F 5/50

[58] Field of Search ... 105/197 D, 197 DB, 197 DH; 267/8 R, 9 A

[56] References Cited

UNITED STATES PATENTS

| | | | |
|---|---|---|---|
| 2,573,165 | 10/1951 | Settles | 105/197 DH |
| 3,406,640 | 10/1968 | Kremen | 105/197 DB |
| 3,626,864 | 12/1971 | Wiebe | 105/197 DH X |
| 3,868,912 | 3/1975 | Wagner et al. | 105/197 DH |

*Primary Examiner*—Robert J. Spar
*Assistant Examiner*—Howard Beltran
*Attorney, Agent, or Firm*—Howard E. Sandler

[57] ABSTRACT

A hydraulic snubber assembly for railroad car trucks and more particularly a hydraulic snubber which is disposed intermediate a bolster and side frame and which includes improved means for biasing and maintaining such snubber into operational position.

9 Claims, 6 Drawing Figures

FIG. 1
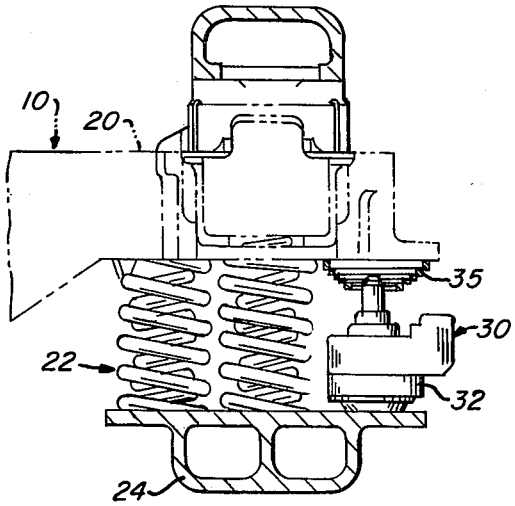
FIG. 2
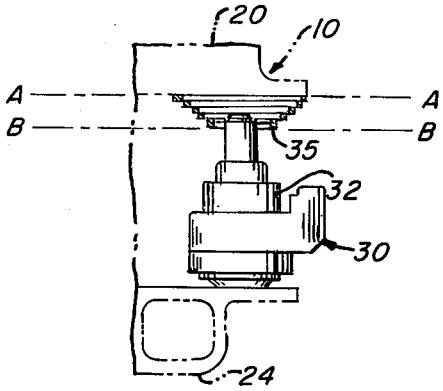
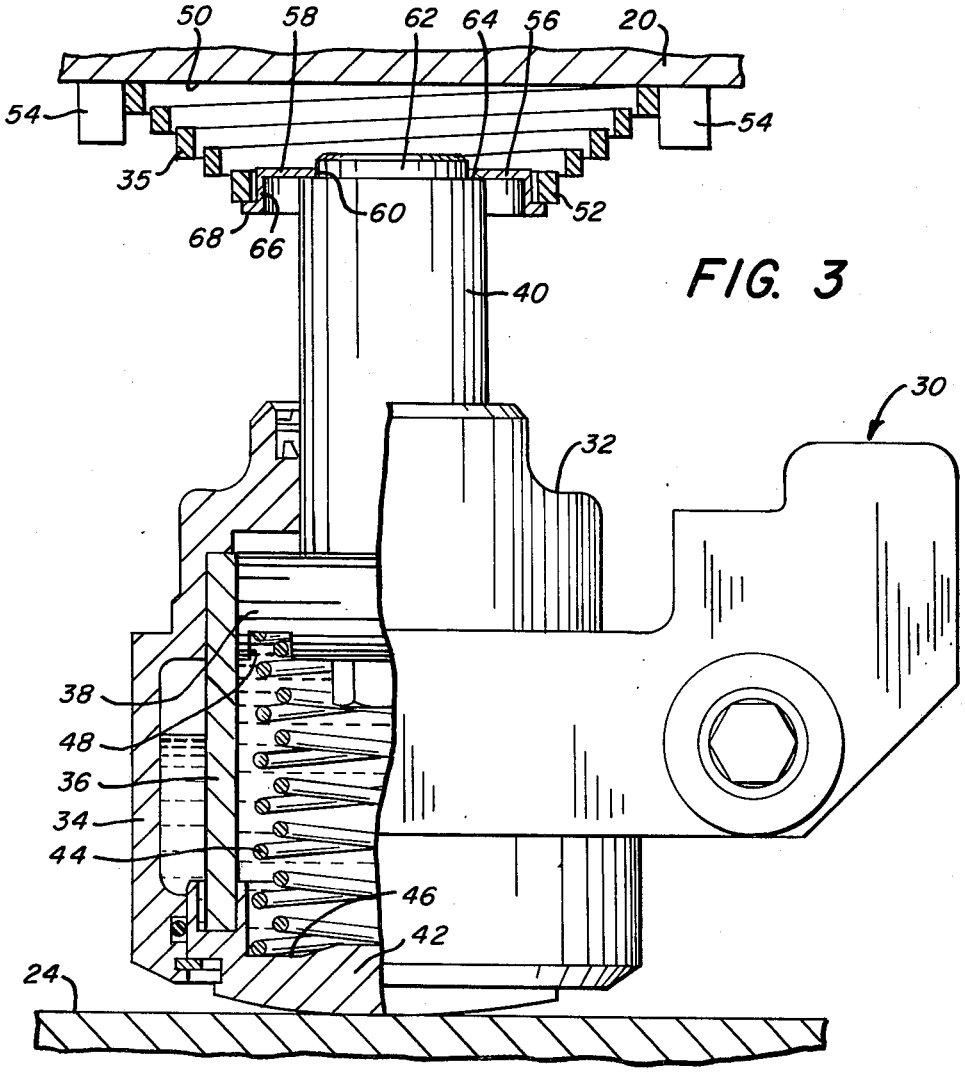
FIG. 3

FLUID TRUCK SNUBBER

As is known, in the normal travel of railway cars over a railbed, various differences in the vertical profile of the laterally spaced trucks resulting from such causes as staggered rail joints and superelevation of the outside track on curves gives rise to a tendency of lateral tilting or swaying of the car body. In modern cars with heavy load capacity and a relatively high center of gravity the forces resulting from the weight shift of the car become so large at times that a variety of effects may develop such as:

1. Complete unloading of the wheels on one side of the truck to the extent of lifting the unloaded wheels off the rail with a high potential of derailment;

2. The imposition of extreme stresses on the car body and truck members; and

3. Cumulative damage and misalignment of track, ties and roadbeds through pounding action.

Various means have been developed to alleviate the above mentioned problem of swaying including the hydraulic snubbing devices described in U.S. patent application Ser. No. 355,058, filed Apr. 27, 1973 now U.S. Pat. No. 3,868,912, and assigned to the same assignee as is this invention. Such application illustrates a frequency responsive hydraulic snubber which is disposed intermediate a side frame and bolster and provided with an external reservoir for hydraulic fluid which cooperates with the snubber cylinder space to virtually eliminate the dead space or ullage volume normally necessary within a closed hydraulic cylinder to provide for the volume of hydraulic liquid which is displaced by the piston rod on the down stroke. By use of such a snubber as described in the aforesaid patent application a high energy absorption rate is available at slow car speeds and large amplitude motions and a low rate of energy absorption is available at high car speeds and relatively smaller amplitude motions thereby controlling the frictional temperature rise of the hydraulic snubbing fluid within an acceptable range, while simultaneously providing an arrangement wherein the snubber is effective over substantially the full stroke thereof with substantially zero ullage volume within the piston cylinder.

The present invention is an improvement over a snubber assembly of the type described in said copending U.S. patent application Ser. No. 355,058, now U.S. Pat. No. 3,868,912, and offers several advantages thereover, for example:

1. By providing biasing means intermediate the bolster or side frame member and the piston rod rather than between either of such members and the snubber casing as was done in prior art snubber assemblies structural alterations to the snubber body are possible to yield a larger fluid reservoir within the same given area. A larger reservoir area for hydraulic fluid permits higher capacity and cooler snubber operation.

2. The inclusion of a biasing means of a frusto conical configuration and at the location specified in paragraph 1 permits superior centering features for the retained snubber.

3. The inclusion of a biasing means at the location specified in paragraph 1 readily permits incorporation of dust protective means therewith to isolate the piston rod from an external environment.

These and other objects and advantages will become more readily apparent upon a reading of the following description and drawings in which:

FIG. 1 is a fragmentary partially sectional and elevational view of a freight car truck incorporating the snubber assembly of this invention;

FIG. 2 is a view similar to FIG. 1 illustrating loaded and unloaded conditions of the freight car incorporating the snubber assembly of this invention;

FIG. 3 is a side elevational view, partly in section, of a snubber constructed in accordance with the principles of the present invention;

Figure 4:
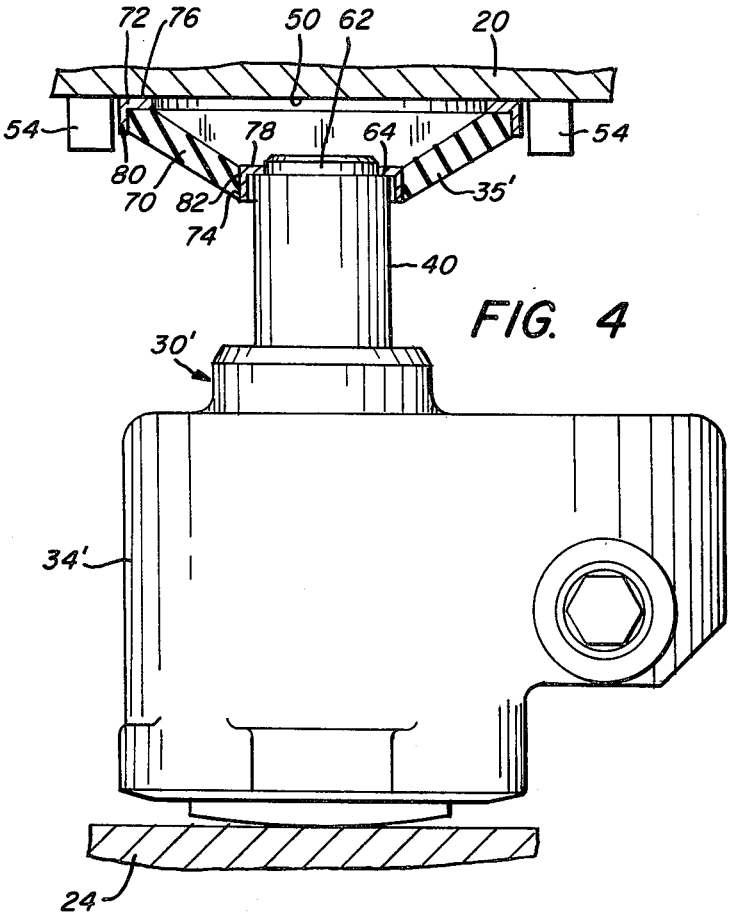
FIG. 4 is a side view, partially in section, of another embodiment of a snubber assembly constructed in accordance with the principles of this invention.

FIG. 1 illustrates a fragmentary portion of a four wheel railway freight truck, generally illustrated at 10, which comprises a centerplate and suitable side bearings (not shown) cooperating with a bolster 20 to support the car body (not shown); spring groups 22 mounted in side frame 24 (only one being shown) to support the bolster 20. Suitably journaled wheels (not shown) support each side frame 24. A snubber assembly of the present invention, generally indicated at 30, is shown as being disposed in the spring group 22.

Inasmuch as the invention herein is primarily directed at snubber assembly 30 and the balance of the elements set forth hereinabove are well known in the art, further description of such elements will not be set forth hereinafter except where necessary to describe snubber assembly 30.

Snubber assembly 30 comprises a snubber 32 and a retention and biasing means 35. Snubber 32 is of any suitable construction as as shown comprises: a hollow body member 34; a hollow cylindrical sleeve 36 received within body member 34; a piston head 38 axially reciprocably received within sleeve 36; a piston rod 40 coaxially secured to piston 38 and extending axially upwardly therefrom through the upper end of body member 34 and a closure and bearing member 42 releasably carried by a member 34 adjacent the lower end thereof. A compression spring set 44 is disposed within the sleeve 36 intermediate the piston head 38 and the closure and bearing member 42 in a manner that the lower end thereof is captively received within annular depression 46 within member 42 and the upper end thereof is captively received in a downwardly open annular groove 48 within piston head 38. Inasmuch as the snubber 32 operates in a well known manner and the invention herein is primarily to a snubber assembly 30 incorporating a retention and biasing means 34, further description of snubber 32 will not be set forth hereinafter except where necessary to describe snubber assembly 30. For a detailed description of the construction and operation of a suitable snubber such as snubber 32, reference is hereby made to the aforementioned copending United States Patent Application Ser. No. 355,058, filed Apr. 27, 1973 now U.S. Pat. No. 3,868,912, issued Mar. 4, 1975.

When the snubber assembly 30 is positioned within the spring group 22 it extends between the side frame 24 and the bolster 20. As seen in FIGS. 2 and 3 when the snubber assembly 30 is in position in an unloaded car the biasing means 35 biases snubber 32 away from bolster 20 in a manner that the engaging surface 50 of bolster 20 will be spaced upwardly at line A—A out of engagement with respect to the uppermost extent of piston rod 40. In this position piston rod 40 is fully extended and piston 38 is adjacent the upper end of sleeve 36. Hence, there would be very little or no action of the snubber 32 even if the car should bounce somewhat or rock slightly as it is being propelled along the rails. The next horizontal line in FIG. 2, namely B—B, represents the normal position of the engaging surface of bolster 20 with respect to the uppermost extent of piston rod 40 wherein piston rod 40 is in engagement with the engaging surface of bolster 20 adjacent thereto. This latter position represents conditions when the car body is operating in a normally loaded condition and the bias of biasing means 35 is overcome. At this juncture it is important to note that the downward force necessary to overcome the bias of biasing means 35 is less than the upward force imparted to piston head 38 by compression spring set 44. Accordingly, piston head 38 will not operationally reciprocate within body member 34 until actual engagement is made between piston rod 40 and the engaging surface of bolster 20. It follows, therefore, that snubber 32 is not operational to damp forces between side frames 24 and bolster 20 until the truck is normally operating in a loaded condition, the bias of biasing means 35 is overcome and the upper end of piston rod 40 engages bolster 20.

As shown in FIG. 3 biasing means 35 comprises a downwardly tapering frusto conical shaped helical spring 52 which communicates between bolster 20 and piston rod 40, is captively retained adjacent the upper larger diameter end thereof by centering lugs 54 carried by bolster 20 and is captively retained adjacent the lower smaller diameter end thereof by a seating member 56. Seating member 56 is of a plate configuration and includes a generally annular main body portion 58 having a central opening 60 therein. The uppermost end portion 62 of piston rod 40 has a reduced diameter with respect to the diameter of piston rod 40 downwardly therefrom with the diameter of rod portion 62 being substantially equal to the diameter of opening 60. In assembled position rod portion 62 extends through opening 60 and seating member 56 is seated on the annular surface 64 existing at the reduced diameter step in piston rod 40. The outer periphery of main body portion 58 is radially spaced outwardly from piston rod 40. Seating member 56 additionally includes a spring retaining flange 66 depending downwardly from body portion 58 adjacent the outer periphery thereof and an annular spring seating portion 68 depending radially outwardly from flange 66 adjacent the lowermost end thereof.

In assembly the inner periphery of the lower and smaller diameter portion of spring 52 is adjacent the outer periphery of flange 66 to prevent transverse movement of the lower end portion of spring 52 and the lowermost end of biasing spring 52 is seated on seating portion 68 to prevent downward movement of spring 52 with respect to piston rod 40. The upper end portion of biasing means 35 is retained from transverse movement with respect to bolster 20 by the inner surface of centering lugs 54 engaging the outer periphery of the larger diameter end portion of spring 52.

The embodiment of FIG. 3 illustrates snubber assembly 30 assembled within the spring group of a railway truck 10 operating in an unloaded condition. Hence, spring 52 is nearly at the fully extended assembled length and snubber 32 is out of operative engagement with bolster 20. As railway truck 10 is loaded spring 52 compresses to lessen the spacing between piston rod 40 and engaging surface 50 of bolster 20 until operative engagement therebetween occurs when truck 10 is operating in a loaded condition. As was mentioned hereinbefore, the bias of spring 52 is less than the upward force imparted to piston head 38 by compression spring set 44. Hence, snubber 32 will not operationally damp forces between side frame 24 and bolster 20 until the truck 10 is normally operating in a loaded condition, the bias of biasing means 35 is overcome and the upper end of piston rod 40 engages bolster 20.

The 36 and operational advantages of incorporating a snubber assembly in a spring group 20 intermediate the bolster 20 and side frame 24 are detailed in the prior art. However, by utilization of applicants' snubber assembly 30 which includes biasing means 35 disposed intermediate bolster 20 and piston rod 40 rather than between bolster 20 and the snubber body member 34 as was taught in the prior art a variety of advantages over such prior art snubber assemblies exist, for example: the ability to use a frusto conical biasing means configuration within the severe space restrictions; the ability to cast a larger fluid reservoir within a given area because the biasing means no longer occupies space on the snubber body member; inasmuch as by necessity the piston rod 40 is a highly machined element having high strength material characteristics, the rod 40 may be better suited in certain instances to take the additional loading imparted directly thereto by the biasing means 30 than is the snubber body member 34; the more convenient incorporation of dust protective means, which isolate the piston rod 40 from an external environment, with the biasing means 30; and the like.

Figure 5:
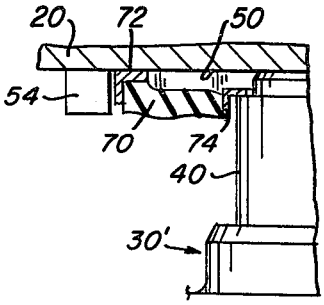
FIG. 5 is a side elevational view, partly in section, of the snubber assembly of FIG. 4 in a loaded condition.

FIGS. 4 and 5 illustrate another embodiment of a snubber assembly, generally indicated at 30′, constructed in accordance with the principles of the present invention. Snubber assembly 30′ is additionally positioned in a spring group 22 intermediate a bolster 20 and side frame 24 and as illustrated comprises a snubber 32′ seated on side frame 24 and being biased away from bolster 20 by means of biasing means 35′ disposed intermediate bolster 20 and piston rod 40.

Biasing means 35′ comprises a downwardly tapering hollow frusto conical biasing member 70 formed of a suitably resilient elastomeric material and which communicate between bolster 20 and piston rod 40. The axial ends of member 70 has respective upper and lower annular metallic retaining members 72 and 74 bounded thereto. Members 72 and 74 have a generally right angle shaped cross section with one leg thereof, 76 and 78, respectively, being generally parallel to the lowermost surface of bolster 20 and the other legs thereof, 80 and 82, respectively, depending downwardly from the radially outermost edges of such legs 76 and 78.

In assembled position member 70 is captively retained adjacent the upper larger diameter end thereof by the upper surface of leg 76 bearing on engaging surface 50 of bolster 20 and the radially outermost surface of leg 76 being adjacent the radially inner surface of centering lugs 54. The lower smaller diameter end of member 70 is retained in operational position by the lowermost surface of leg 78 being seated on annular surface 64 of piston rod 40 and the radially innermost surface of leg 78 being radially adjacent portion of the outer periphery of piston rod 40 downwardly adjacent from piston rod end portion 62.

FIG. 4 illustrates snubber assembly 30' when the railway truck 10 is in an unloaded condition in FIG. 5 illustrates assembly 30' when truck 10 is normally operating in a loaded condition. Accordingly, in FIG. 4 member 70 is in a non-deformed normal position and in FIG. 5 the member 70 is deformed to permit piston rod 40 to engage bolster 20 thereby rendering snubber 32' operational. The biasing force of member 70 is achieved through the particular structural configuration and elastomeric properties chosen and in all instances such biasing force is calculated to be less than the upward biasing force on piston 38 which is exerted by compression spring set 44. Furthermore the structural configuration and physical properties of member 70 are such that member 70 will be relatively stiff in the transverse direction and soft in the vertical direction thereby allowing any deflection thereof between rod 40 and bolster surface 50 prior to any deflection of movement of rod 40 with respect to spring set 44.

Snubber 32' is in all instances illustrated as a duplicate of snubber 32 except the body member 34' of snubber 32' is shown as being structured, to take advantage of the additional space resulting from a snubber assembly of this invention, in a manner that the permissible reservoir area within given structural limitations is increased over prior art devices adjacent the upper end of body member 34'. An additional advantage of snubber assembly 30' over snubber assembly 30 described hereinbefore is apparent from the fact that member 70 is solid and surrounds piston rod 40 in all positions. Accordingly, member 70 not only acts as a biasing means but it also serves the purpose of isolating piston rod 40 from external environment.

Figure 6:
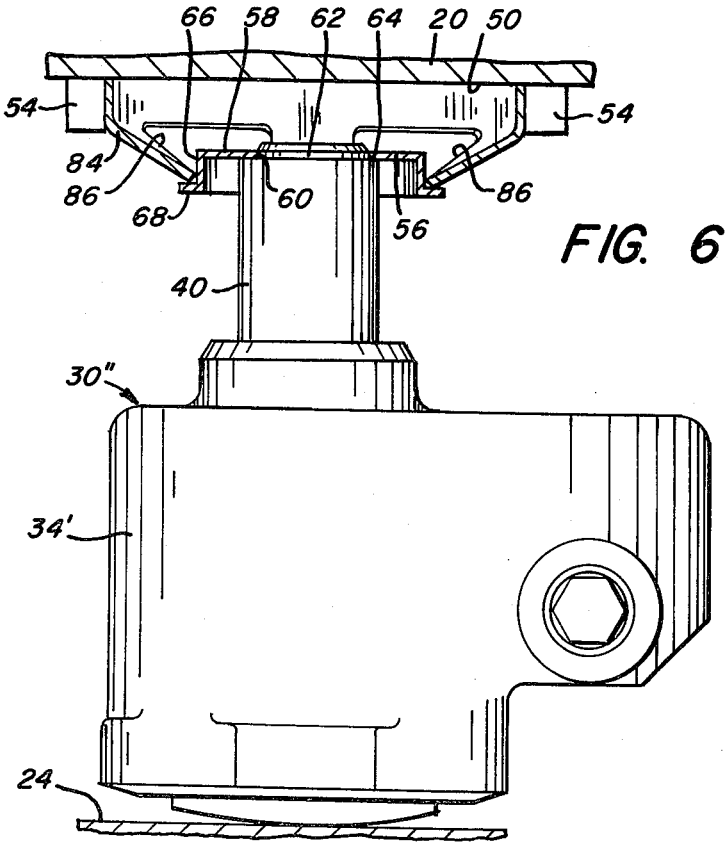
FIG. 6 is a side elevational view, partly in section, of still another embodiment of a snubber assembly constructed in accordance with the principles of this invention.

FIG. 6 illustrates still another embodiment of a snubber assembly generally indicated at 30'' constructed in accordance with the principles of the present invention. Snubber assembly 30'' is substantially identical to snubber assembly 30 described hereinbefore with the primary distinction therebetween being that in snubber assembly 30'' a hollow biasing member 84 is substituted for the spring 52 of snubber assembly 30. Biasing member 84 has a downwardly tapering generally frusto conical configuration, is formed of spring steel and has a plurality of circumferentially spaced downwardly open openings 86 formed therewithin. Openings 86 aid in the deformation characteristics of member 86. Member 86 is captively retained intermediate lugs 54 and seating member 56 and is rendered operational in a similar manner as described hereinbefore with respect to spring 52.

The embodiments illustrated hereinabove illustrate a biasing means disposed intermediate a bolster member and a snubber piston rod; however, it is to be understood that alternatives can be made to the embodiments described herein without departing from the scope of this invention; for example, alternative configuration of the external snubber biasing means are contemplated; alternative biasing means seating and retaining arrangements are possible; and the like. Furthermore, although the snubbers illustrated in the embodiments described hereinabove are of the type wherein the piston member is internally biased upwardly and is spaced from the bolster member during unloaded conditions, the invention herein is equally applicable with the type of snubber having the piston member internally biased downwardly and spaced from the side frame member during unloaded conditions. In such alternative embodiment a biasing means such as biasing means 30 would be captively retained and extend between the side frame 24 and piston rod 40 rather than between bolster 20 and piston rod 40. Accordingly, it is to be understood that the scope of the present invention is to be defined only by the scope of the claims set forth hereinafter.

What is claimed is:

1. In a railway truck snubber assembly adapted to be interposed in a spring group intermediate a bolster member and side frame member of a railway truck assembly, the improvement comprising: a hydraulic snubber having a piston assembly telescopically movable with respect to a snubber casing, along an axis; said piston assembly having one end portion thereof slidably received within said snubber casing; biasing means received within said casing and operative to bias said piston assembly away from said casing along said axis; other biasing means adapted to be directly interposed intermediate said snubber and one of such members to bias said snubber towards the other of such members; said other biasing means being operationally adapted to have one end portion thereof engage a piston rod of said piston assembly adjacent the other end portion thereof and to have the other end portion of said biasing means directly communicate with the one of such members; said other biasing means being operative to bias said snubber out of operative engagement with the one of such members when such railway truck assembly is normally operating in an unloaded condition; the biasing force of said other biasing means being always less than the biasing force of said biasing means; and said other biasing means and said snubber being cooperable to initiate hydraulic snubbing by said snubber substantially only when such railway truck assembly is normally operating in a loaded condition, the bias of said other means is partially overcome and said snubber is in operative engagement with both of such members.

2. In a railway truck snubber assembly as specified in claim 1 wherein said other biasing means includes a main body portion of a generally frusto conical configuration with the smaller diameter end portion thereof being said one end portion.

3. In a railway truck snubber assembly as specified in claim 2 wherein said main body portion is formed of an elastomeric material.

4. In a railway truck snubber assembly as specified in claim 2 wherein said main body portion is a spiral metallic spring.

5. In a railway truck snubber assembly as specified in claim 2 wherein said main body portion is formed of metallic spring steel.

6. In a dampened railway truck assembly selectively operable in loaded and unloaded conditions and having a hydraulic snubber interposed in the spring group intermediate a bolster member and a side frame member, the improvement comprising: said snubber including a piston assembly telescopically movable with respect to a snubber casing; biasing means received within said casing and operative to bias said piston assembly away from said casing along said axis; other biasing means directly interposed between said snubber and one of said members to bias said snubber towards the other of said members; said other biasing means having one end portion thereof engaging a piston rod of said piston assembly adjacent the other end portion thereof and having the other end portion of said other biasing means communicating directly with said one of said members; said other biasing means being operative to bias said snubber out of operative engagement with said one of said members when said railway truck assembly is normally operating in an unloaded condition; the biasing force of said other biasing means being always less than the biasing force of said biasing means; and said other biasing means and said snubber being cooperable to initiate hydraulic snubbing by said snubber substantially only when said railway truck assembly is normally operating in a loaded condition, the bias of said other means is at least partially overcome and said snubber is in operative engagement with both of said members.

7. In a railway truck assembly as specified in claim 6 wherein when said truck assembly is normally operating in an unloaded condition said snubber engages only said other of said members.

8. In a railway truck assembly as specified in claim 7 wherein when said truck assembly is normally operating in said loaded condition said snubber is simultaneously in engagement with both of said members.

9. In a railway truck assembly as specified in claim 6 wherein said other biasing means includes a main body portion of a generally frusto conical configuration with the smaller diameter end portion thereof being said one end portion.

* * * * *